US005226547A

United States Patent [19]

Malatesta

[11] Patent Number: 5,226,547

[45] Date of Patent: Jul. 13, 1993

[54] MAIL TRANSPORT ASSEMBLY FOR MAIL SORTING SYSTEM

[75] Inventor: James Malatesta, Hockessin, Del.

[73] Assignee: Tritek Technologies, Inc., Newark, Del.

[21] Appl. No.: 687,671

[22] Filed: Apr. 19, 1991

[51] Int. Cl.[5] ..... B07B 5/36

[52] U.S. Cl. ..... 209/657; 209/584; 209/900; 209/925; 271/305

[58] Field of Search ..... 209/657, 583, 584, 900, 209/925; 271/305

[56] References Cited

U.S. PATENT DOCUMENTS

| | | | |
|---|---|---|---|
| 3,347,367 | 10/1967 | Smith | 271/305 X |
| 3,430,950 | 3/1969 | Marsh et al. | 271/305 X |
| 3,717,249 | 2/1973 | Faley | 209/925 X |
| 4,623,140 | 11/1986 | Allio et al. | 271/305 X |
| 4,718,660 | 1/1988 | Daboub | 209/657 X |

FOREIGN PATENT DOCUMENTS

| | | | |
|---|---|---|---|
| 2630355 | 10/1989 | France | 209/900 X |

*Primary Examiner*—Donald T. Hajec

*Attorney, Agent, or Firm*—Connolly & Hutz

[57] ABSTRACT

A mail transport assembly for a mail sorting system includes a plurality of sets of drive units mounted on a transport surface. Each of the sets includes at least one diverter pivotally mounted to two positions. An endless inner belt is rotationally mounted generally in line with the diverter in one of the positions of the diverter. A drive belt has a run in contact with the inner belt so as to convey items of mail in a downstream direction when the item is directed thereto by the diverter. An intermediate belt is located with a run in contact with the inner belt so that rotation of one of the belts causes the other belt to rotate. A side belt is in contact with the intermediate belt to drive mail directed by the diverter into a collecting bin.

22 Claims, 3 Drawing Sheets 10
14
16
M
17
2
28
60
30
46
80A
26
12
24
64
84
62
36
20
22
16A
17A
30A
28A
85
12A
80B
46A
M1
62A
60A
36A
16B
17B
12B
M2
28B
30B
84
46B
80C
64B
58B
30C
80D
12C
66
68
72
70
14
146
136
146A
136A
146B
136B
146C
136C

MAIL TRANSPORT ASSEMBLY FOR MAIL SORTING SYSTEM

BACKGROUND OF INVENTION

With the ever increase in the cost of mail great efforts have been expended to sort mail into, for example, common categories. A frequent sorting is done by way of zip codes. If, for example, a company such as an insurance company or a direct mail advertising company could group the individual items of mail from the same zip code into a common batch then advantage could be taken of the bulk mail rate. With such company, such bulk rate reductions constitute a significant cost savings which would be desirable if a mail sorting system could have a high speed and efficient transport assembly to facilitate the classification of individual flat items of mail. Such a system should have ready adaptability to the various automated mail sorting systems being devised, whether for use by private companies or for the Post Office.

A particularly efficient mail sorting system is TRI-TEK TM 88-5. This system uses a optical character reader to presort mail in private industries and mail houses. The system includes a support surface on which the mail is conveyed by means of sets of belts movably mounted on rollers. A reader arrangement determines which of a plurality of bins would receive the individual items of mail in individual categories such as defined by different zip codes. The transport assembly which receives the mail and directs it into the individual bins, includes pivotal diverters associated with sets of belts and light tracking devices to receive and direct the mail into the individual bins.

SUMMARY OF INVENTION

An object of this invention is to provide a mail transport assembly which is particularly adapted for use with a high speed mail sorting system.

A further object of this invention is to provide a mail transport assembly capable of handling flat items known as "flats" of mail over a wide range of thicknesses.

A still further object of this invention is to provide such a mail transport assembly which is quick and efficient in operation with minimal parts and minimal maintenance requirements.

In accordance with this invention, the mail transport assembly includes a transport surface on which is mounted a plurality of sets of drive units disposed adjacent each other. Each of the drive units includes a pivotally mounted diverter which is capable of being pivoted to two different positions. An inner belt is mounted generally in line with the diverter in one of the diverter positions to receive mail directed by the diverter. The mail is driven downstream by the inner belt and a drive belt disposed in contact with the inner belt. An intermediate belt is rotatably mounted in contact with the inner belt and includes a run in line with the diverter in the second position of the diverter. A side belt contacts a run of the intermediate belt to drive the item of mail toward and into a bin.

In the preferred practice of the invention, each set of drive units includes a pair of diverters and of inner belts and of intermediate belts and of side belts with each inner belt functioning as the drive belt for the other inner belt. Each group of inner belt and intermediate belt and side belt includes a single drive roller so that all of the belts are driven in their proper direction and at their proper speed by only two drive rollers in each set of drive units.

Advantageously, the intermediate belt includes a roller disposed adjacent a mail collecting bin. The roller has the dual function of acting as a pivot point about which the flat item of mail pivots when it is being disposed in the bin and to drive the outermost item of mail in the bin toward the wall of the bin.

THE DRAWINGS

FIG. 3 is a bottom plan view showing the drive roller arrangement for the mail transport assembly shown in FIG. 1.

DETAILED DESCRIPTION

The present invention is directed to a mail transport assembly, particularly designed for use with a high speed automated mail sorting system such as the TRI-TEK TM 88-5 Multiline OCR Bar Code Sorting System. Such system is capable of sorting over 30,000 pieces of mail per hour. The present invention may utilize various aspects of the 88-5 sorting system such as the optical character reader which presorts the mail into individual categories such as by zip code. In particular, however, the present invention is intended to improve the mail transport assembly portion of the mail sorting system which receives the mail and directs it into the individual bins in accordance with, for example, the presorting techniques of the 88-5 system or any other suitable mail sorting system capable of differentiating one item of mail from another so as to sort the items into individual categories preferably by zip codes.

Figure 1:
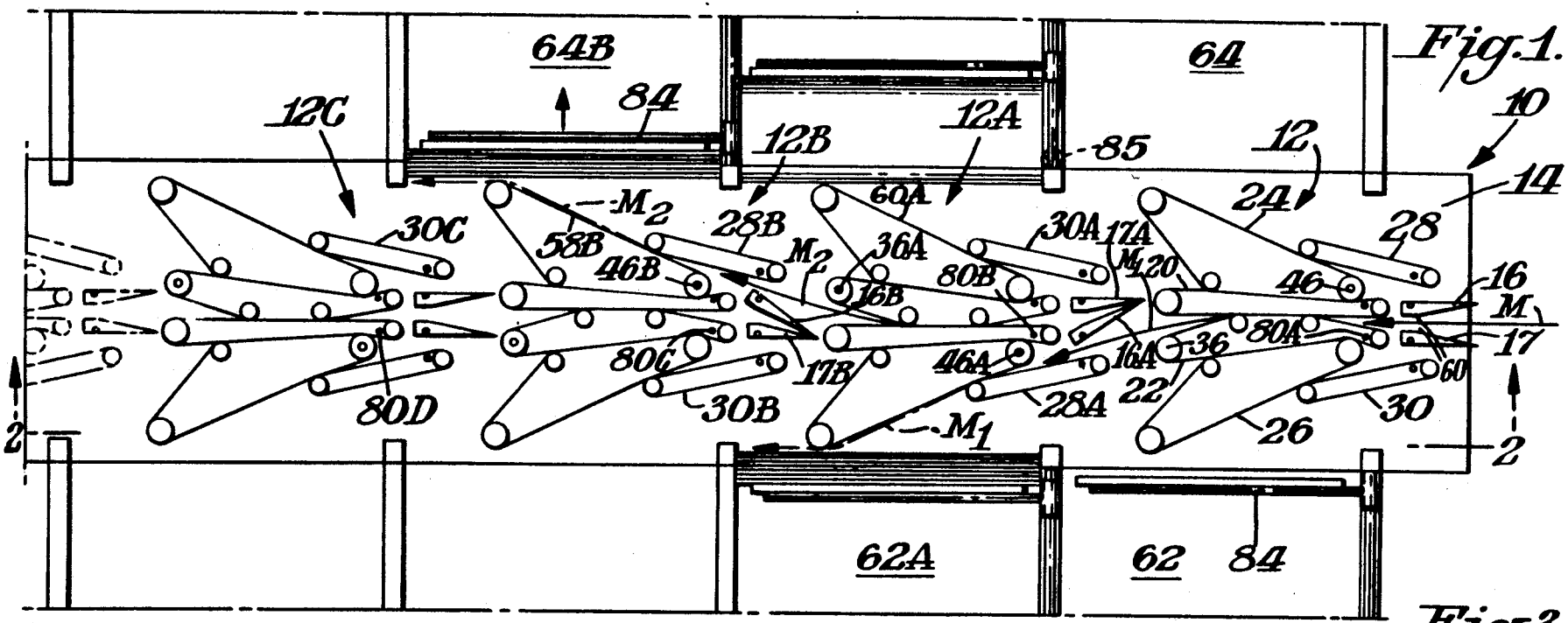
FIG. 1 is a top plan view of a mail transport assembly in accordance with this invention.
Figure 2:
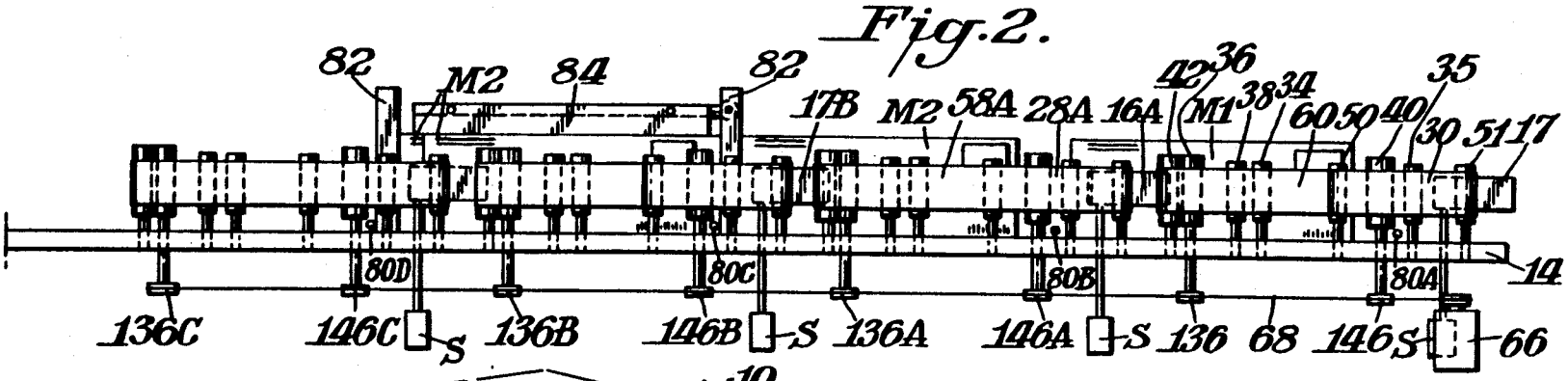
FIG. 2 is a cross sectional view taken through FIG. along the line 2—2.

FIGS. 1-3 illustrate to scale the mail transport system 10 in accordance with this invention. As shown therein a plurality of drive units 12, 12A, 12B, 12C, etc. is provided in line with each other on a flat support surface 14. All drive units are essentially the same. Thus the letters A, B, C, etc. are used to differentiate the individual units. A pair of diverters 16,17 similar to the diverters in the 88-5 sorting system are located at the upstream end of each drive unit. Each diverter is pivotally mounted at pin 18 to be moved into one of two different positions for purposes later described. The pivotal movement of each diverter is controlled by a solenoid S illustrated in FIG. 2. Each unit 12 also includes two groups of belts and rollers. The groups comprise a pair of inner belts 20,22 and a pair of intermediate belts 24,26 and a pair of side belts 28,30.

Figure 1A:
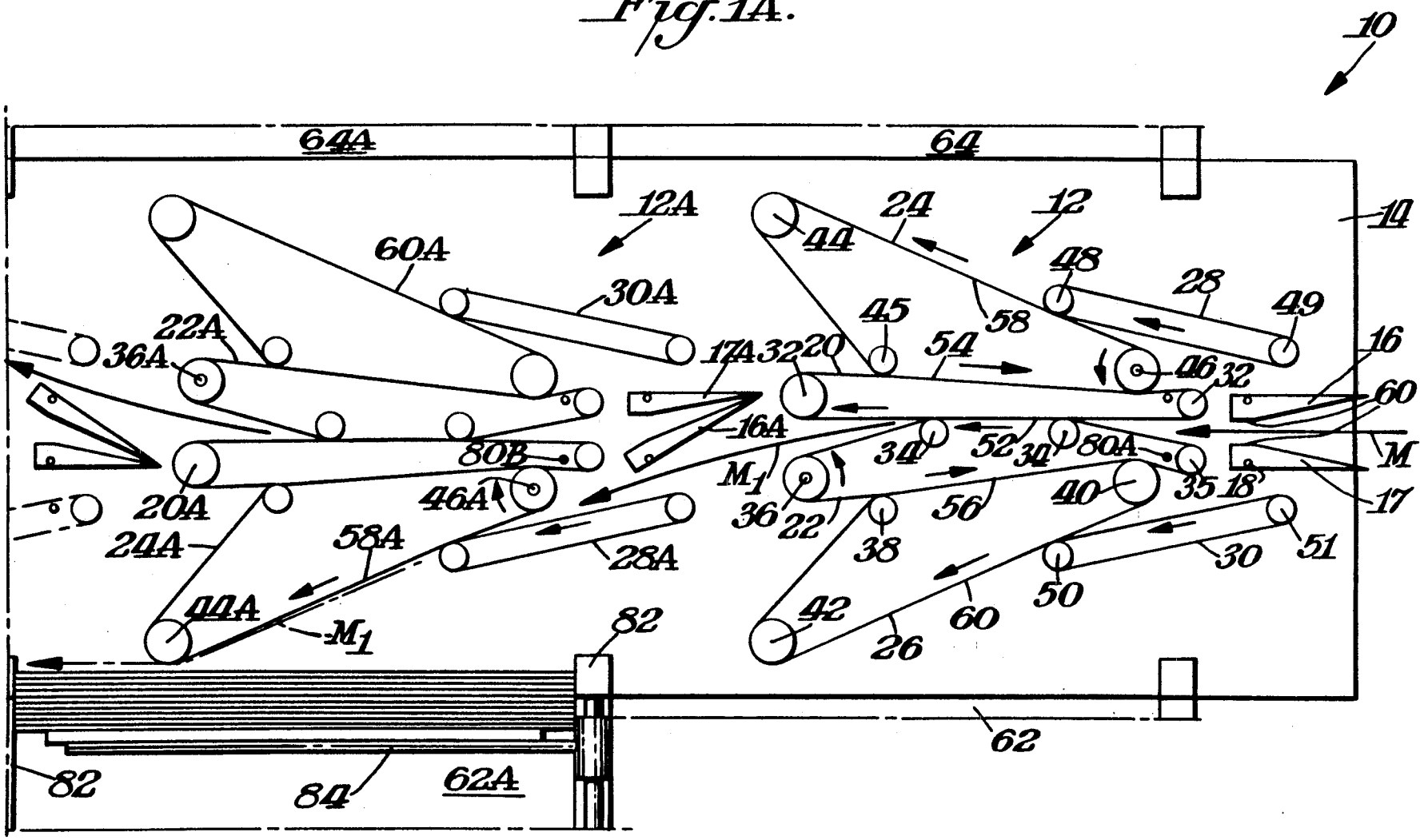
FIG. 1A is an enlarged view of a portion of the assembly of FIG. 1.

FIG. 1A illustrates the details of one drive unit 12. As shown, belt 20 is mounted around a pair of idler rollers 32, 32. Belt 22 is mounted around a set of idler rollers 34, 34, 35 and a drive roller 36. Belt 26 is mounted around idler rollers 38, 40, 42. Intermediate belt 24 is mounted around a pair of idler rollers 44, 45 and around a drive roller 46. Side belt 28 is mounted around a pair of idler rollers 48,49 while side belt 30 is mounted around a pair of idler rollers 50,51.

As also illustrated in FIG. 1A the run 52 of belt 22 between the central pair of its rollers 34,34 is in contact with belt 20. Each intermediate belt 24,26 includes a first run 54,56 which is in contact with a portion of inner belt 20 and 22, respectively. The various rollers are arranged so that the runs of the inner belts which contact the intermediate belts is deflected from its straight line path to assure that there will be contact between each pair of inner belts and intermediate belts. Each intermediate belt 24,26 includes a second run 58,60. Second run 58 is in contact with belt 28 at roller 48. Similarly, the second run 60 of intermediate belt 26 contacts belt 30 at roller 50.

Each of the downstream units 12A, 12B, 12C, etc. includes the same number of belts, rollers and diverters except that there is a reversal of the roller belt arrangements with respect to the inner and intermediate belts in adjacent units. Accordingly, in the second unit 12A the diverter 16A and belts 20A, 24A and 28A are on the opposite side of the longitudinal center line or axis of support surface 14 than the corresponding diverter 16 and belts 20, 24 and 28 of the first unit 12. Alternate units 12B, 12D etc. would have their belts, rollers and diverters in the same arrangement as unit 12 while alternate units 12C, 12E, etc. would be similar to unit 12A. The alternating arrangement of units would continue throughout the length of the mail transport assembly which could include 256 bins and 128 drive units on centerline belts and 128 on outside "stacker" belts.

As previously indicated each diverter 16,17 is pivotally movable by solenoid S to one of two different positions. For example, in unit 12 diverters 16,17 are each in one position where their surfaces 60 are generally in line with the runs at the entrance to inner belts 20,22. In this position, a piece of mail M would be directed through diverters 16,17 and into contact with rotating belts 20,22 where it would be discharged toward the set of diverters 16A,17A.

Unit 12A shows diverter 16A in its second position with diverter 17A in its original or first position. In this condition a piece of mail M passing from unit 12 would be directed toward the nip formed by second run 58A and belt 28A for eventual delivery into bin 62A.

Unit 12B (FIG. 1) shows diverter 16B inclined to its second position and diverter 17B in its original or first position. In this condition, a piece of mail $M_2$ would be directed to the nip formed by belt 28B and second run 58B so that the piece of mail $M_2$ would be deposited in bin 64B.

As is apparent from FIG. 1, two sets of bins 62A, 62B, 62C etc. and 64A, 64B, 64C etc. are provided on each side of the drive units 12A, 12B, 12C, etc. A piece of mail would be directed into each bin in accordance with the orientation of the set of diverters at the upstream end of each unit. A piece of mail would be directed into bin 62 if diverter 17 were pivoted similar to the position of diverter 16A. Conversely, mail would be directed into bin 64 if diverter 16 were pivoted to the position of diverter 16B. Similarly, a piece of mail would be directed to bin 62A when the diverter 16A and 16B are as illustrated. Thus, where the diverters assume their straight or first position as illustrated by diverters 16,17 the mail would continue to be directed from one unit to another until eventually the mail reached the proper bin into which it would be directed by the suitable inclining of one of the diverters to its second position.

The mail transport assembly 10 includes a number of distinctive features. One particularly important feature is the inclusion of only one drive roller for each group of inner belt, intermediate belt and side belt. For example, drive roller 46 would cause intermediate belt 24 to rotate in the direction of the arrow in FIG. 1A. Belt 24 by contacting run 54 would cause belt 20 to rotate as indicated by the arrows. Similarly, belt 24 by contacting belt 28 at roller 48 would cause belt 28 to rotate in the direction indicated. The drive roller 36 would have a similar affect to drive its belt 22 which in turn would drive intermediate belt 26 which would drive side belt 30 in the direction indicated by the arrows. The use of this minimal number of drive rollers greatly simplifies the operation of mail transport assembly 10 and also does not impede machine performance.

FIG. 3 illustrates how all of the drive rollers and the corresponding groups of belts are driven from a single motor. As shown therein motor 66 drives belt 68 along the indicated path defined by belt 68 making contact with tensioner 70 and the various rollers 146, 136A, 146B, 136C, 146C, 136B, 146A and 136. Each of these rollers is mounted to the same shaft as their corresponding drive rollers 46, 36A, 46B, etc. Advantageously each unit 12 uses only two drive rollers which effectively rotates the various contacting belts in opposite directions from each other. This arrangement makes possible the use of a single drive belt 68 off motor 66 which causes the various drive rollers to rotate in opposite directions.

The drive system wherein one drive roller drives three belts assures that there will be non-variable speeds of the belts and therefore non-variable or uniform speed of the items of mail to correlate the movement of the items of mail past the later described light tracking systems 80, 80A, 80B, etc. The common drive for all of the belts in the transport assembly 10 also assures that all of the belts move at the same speed to uniformly drive the mail from one unit to another.

The arrangement illustrated in FIG. 3 is for four sets of bins and four drive units. The same arrangement could be extended indefinitely for any number of additional drive units by the adding of a further set of drive rollers for each added drive unit and extending belt 68 around all of the corresponding rollers for a maximum of 16 bins for every belt 68. The provision of a common drive for all systems is particularly advantageous since it assures that all of the belts move at the same speed to uniformly drive the mail from one drive unit to another. Additionally the common drive permits a simplified drive system.

Any suitable tensioning device may be used for assuring the proper tension of belt 68. In the illustrated embodiment the tension roller 70 is provided with a screw adjusting mechanism 72 to move roller 70 further from motor 66 or to permit roller 70 to move closer to motor 66 in accordance with the desired tension.

A particularly advantageous feature of the invention is the location of rollers 42 and 44 of the intermediate belt units. In this respect, rollers 42 and 44 are arranged at the entrance to each respective bin 62,64. Each bin is in the form of a pair of fixed walls 82,82. A sliding stop wall 84 is slidably mounted to one of the fixed walls and extends almost to its opposite fixed wall as best shown in FIG. 1A. When the first item of mail is deposited in a bin it would be disposed in an upright position against sliding wall 84 and the downstream fixed wall 82. Wall 84 is urged to the front of the bin by an attached counterweight 85. As new items are deposited, sliding wall 84 is pushed deeper into its bin. The end rollers 42,44 advantageously function to cooperate with the structure of the bins. In this respect, these rollers 42,44 act as pivot points. Thus, when an item of mail, such as item $M_1$, is released from its contact by its belt 28A the item of mail $M_1$ would continue to ride against the run 58A of the intermediate belt 24A. When the item of mail reaches the end roller 44A the item would pivot about that end roller so as to be in the proper position which is generally parallel to slide wall 84 for being disposed in its bin. The constantly rotating belt 24A would act to continue to drive the item of mail in a downstream direction and thus maintain it in contact with the downstream wall 82 of its bin 62A. The same actions would result for depositing each item into its proper bin.

The side belt units 28,30 are also an advantageous feature of this invention. These belts act to accelerate the rotation of the intermediate belts and also function to drive items of mail intended for their respective bins.

Among the characteristics of the invention is that an item of mail moving through a plurality of drive units does not actually move at a straight or axial path. In this respect, as shown in FIG. 1, an item of mail would enter unit 12 generally along the centerline of the unit between the diverter 16,17. If the item of mail is directed to the next unit 12A, its path is altered slightly closer to bin 64 as the item of mail passes between inner belts 20,22. The item is then directed through the next set of diverters 16A,17A and if it is intended to be moved to the next unit 12B, its path is altered in the opposite direction slightly closer to bin 62A as it passes through inner belts 20A and 22A. This slightly zig zag type motion continues until the item of mail is deposited in its intended bin.

A further feature of the invention is that there is surface contact for each item of mail throughout its path until being deposited in a respective bin. The various components of mail transport assembly 10 may be suitably dimensioned over a range of dimensions to achieve their intended purpose. In the preferred practice of the invention the tracking cycle or effective length of each drive unit 12 is 18 inches. The length of contact between rollers 34,34 of inner belt 22 is $3\frac{7}{8}$ inches. Accordingly, this would be the length of contact that each item of mail would make with the corresponding belts 20,22. The distance that an item of mail would travel as it passes through a set of diverters 16,17 and until it becomes engaged between belts 20,22 is preferably about $4\frac{5}{8}$ inches. The distance an item of mail would travel as it passes through a set of diverters 16,17 and until it is engaged between belts 24,28 or 26,30 would be about 6 inches. The distance an item of mail would travel while it remains in contact with belt 24 or 26, but after it has been released by side belt 28 or 30 is about $14\frac{3}{4}$ inches. After passing from contact with intermediate belt 24 or 26 the item of mail would then be deposited in a suitable bin. The distance that an item of mail would travel after it leaves contact between inner belts 20,22 and begins to pass through a set of diverters 16A,17A is for example $4\frac{1}{8}$. These dimensions have been selected since they assure that items of mail could be handled over a variety of lengths and still be transported in a proper manner by assembly 10. Where an item of mail is in contact with only one belt, such as the second or outer run of an intermediate belt, that belt functions to transport the item in a downstream direction. If the item should be of such a short length that it is not in contact with any belt over a small distance of its travel, the momentum provided by the belt from which it was discharged would maintain the item in its intended path until it is received by the next belt or received in its proper bin.

A significant feature of this invention is that the mail transport assembly 10 is capable of handling any size mail limited in thickness only by the distance between diverters 16, 17. This is accomplished because of the use of flexible belts and the fact that no two rollers are positioned opposite each other along the lengths of contact of pairs of belts. The closest positioning of rollers along the path of travel of the mail is the rollers 32,35 at the entrance of the path formed by belts 20,22. The entrance rollers, however, are located away from each other the same distance as the diverters. Thus the entrance rollers do not restrict mail thickness.

Any suitable materials may be used for the components of mail transport assembly 10. It is preferred, however, that high friction material be used for the belts to assure imparting a momentum to the items of mail and minimize any slippage and to assure that contact by one belt will effective drive its other belt.

Figure 4:
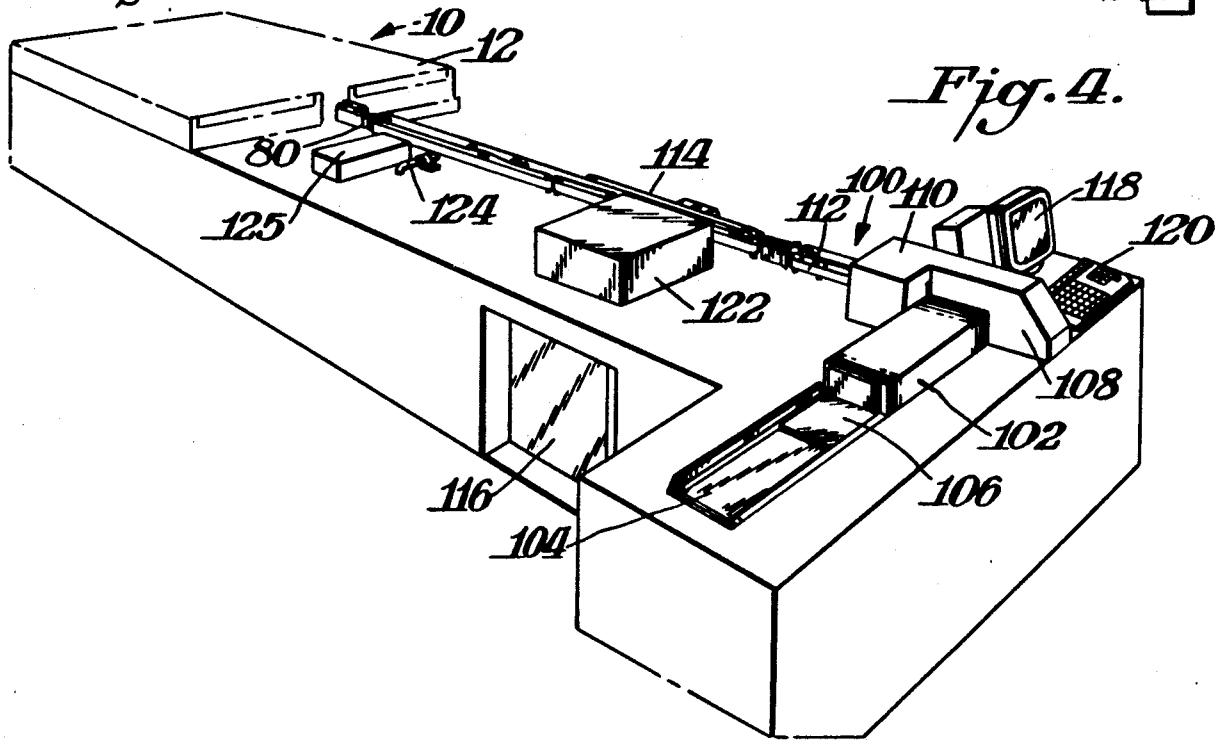
FIG. 4 is a perspective view of a mail sorter with which the transport assembly of FIGS. 1-3 is usable.

FIG. 4 illustrates the overall operation of the mail transport assembly 10 in conjunction with a suitable mail sorting system such as the 88-5 sorting system 100. Since such system is known in the art a detailed description is not necessary except as it facilitates an understanding of the present invention. With the 88-5 system it is possible to sort over 30,000 pieces of mail per hour. The system could include, for example, 256 possible bins to accept the individual categories of mail. In general, the system 100 involves placing trays 102 of mail on a flat conveyor belt 104. The L-shaped bracket 106 at the end of tray 102 is driven by belt 104 to urge the stack of mail against a fixed wall 108 of a vacuum feeder 110. Vacuum feeder 110 individually removes each item of mail one at a time and directs it between a pair of conveying belts 112 which in turn directs each item of mail to further downstream conveying belts 114. The system is controlled by a suitable computer mounted in a air conditioned cabinet 116 with the CPU unit 118 and its keyboard 120 being located on support surface 14. As the mail is transported between belts 114 it is scanned by optical character reader 122 which reads the zip code and transmits the information back to the computer. The 88-5 unit also includes a bar code reader 125 having a bar code printer 124 to provide further individual information regarding the item of mail. Based upon the information fed to it, the computer controls the selective operation of the solenoids S (FIG. 2) to control the orientation of the individual diverters 16,17 in transport assembly 10. Each unit 12, 12A, etc. includes a light tracking arrangement 80, 80A, etc. which senses the passing of an item of mail into the mail transport assembly. Such a light tracking arrangement would be provided upstream from each set of diverters. Thus the light tracking arrangement 80A of unit 12A is physically in unit 12 downstream from diverters 16,17. Light tracking arrangement 80A confirms that an item of mail has correctly passed through diverters 16,17 and is being directed to the drive unit 12A. Similarly, a light transmitting arrangement 80B is provided downstream from diverter 16A,17A to confirm the passage of an item of mail that is intended to be transported to the next unit 12B. Further light transmitting arrangements 80C, 80D, etc. are provided in transport assembly 10.

While this invention has been described with particularity for its adaptability to the 88-5 mail sorter, the concepts of this invention may be used for other types of mail sorters. It is possible, for example, to broadly practice the invention using only one set of bins on only one side of the support surface. In this practice, each drive unit would include one pivotal diverter and one group of inner, intermediate and side belts as previously described. A second group of such belts, however, would not be necessary, except for the inclusion of a further belt which physically would correspond to the inner belt and would function as a drive belt for directing an item of mail to the next downstream unit.

As can be appreciated, the present system is particularly adapted to the handling of high speed mail by depositing different individual items in their intended bins in a quick and reliable manner. Moreover, this is done by a system which minimizes mechanical parts so as to reduce the possibility of malfunction and to facilitate any repair or replacement should such be necessary.

What is claimed is:

1. A mail transport assembly for a mail sorting system having means for classifying individual items of mail into preselected categories including a plurality of receiving bins for selectively holding individual items of mail in their separate categories, said assembly comprising a transport surface, a plurality of sets of drive units disposed adjacent each other on said support surface, each of said drive units having a pivotally mounted diverter for being pivoted to a first and a second position, an inner belt mounted for rotational movement around spaced rollers, said inner belt being disposed generally in line with said diverter when said diverter is in said first position, a drive belt mounted around spaced rollers opposite said inner belt, said drive belt and said inner belt having runs in contact with each other to drive an item of mail in a downstream direction, an intermediate belt rotatably mounted around spaced rollers, said intermediate belt and said inner belt having runs in contact with each other whereby rotation of one of said belts causes rotation of the other of said belts, said intermediate belt having a second run disposed generally in line with said diverter when said diverter is in said second position, a side belt rotatably mounted around spaced rollers, said side belt being in contact with said second run of said intermediate belt to drive an item of mail in a downstream direction and then direct the item of mail into a bin at least partially downstream from said intermediate belt, and one of said rollers of the group of belts formed by said inner belt and said intermediate belt and said side belt being a drive roller whereby the driving of said drive roller causes all of said group of belts to rotate.

2. The assembly of claim 1 wherein each of said drive units comprises two of said groups of belts, said inner belt of each of said groups being said drive belt for its other group, and each unit having a pair of pivotal spaced diverters.

3. The assembly of claim 2 wherein each of said intermediate belt rollers includes an end roller disposed at the entrance to a respective bin, each bin having a fixed wall generally perpendicular to the longitudinal centerline of said support surface whereby the lead edge of items of mail deposited in said bin is disposed against said fixed wall, said end roller functioning as pivot means to dispose the item of mail being deposited into said bin generally perpendicular to said fixed wall, and said intermediate belt functioning to maintain the item of mail in contact with said fixed wall.

4. The assembly of claim 3 wherein each bin includes a sliding stop wall disposed generally perpendicular to said fixed wall, and said sliding stop wall being urged to the front of said bin by an attached counterweight.

5. The assembly of claim 3 wherein each of said groups of belts includes a single drive roller whereby all of said belts in each of said drive units are driven by only two drive rollers.

6. The assembly of claim 5 including a drive motor, a driving belt driven by said motor, and said driving belt being in driving contact with each of said drive rollers whereby all of said drive rollers are driven by the same driving belt and motor.

7. The assembly of claim 6 including tensioning means for adjusting the tension of said driving belt.

8. The assembly of claim 6 wherein said drive roller of one of said groups is located in contact with said inner belt of its group, and said drive roller of said other of said groups being located in contact with its said intermediate belt.

9. The assembly of claim 7 wherein said inner belt drive rollers is located on opposite sides of the longitudinal centerline of said support surface in adjacent drive units.

10. The assembly of claim 9 wherein the path of travel of items of mail downstream through a plurality of said units is along a non-straight line.

11. The assembly of claim 2 wherein each of said groups of belts includes a single drive roller whereby all of said belts in each of said drive units are driven by only two drive rollers.

12. The assembly of claim 11 including a drive motor, a driving belt driven by said motor, and said driving belt being in driving contact with each of said drive rollers whereby all of said drive rollers are driven by the same driving belt and motor.

13. The assembly of claim 12 wherein said drive roller of one of said groups is located in contact with said inner belt of its group, and said drive roller of said other of said groups being located in contact with its said intermediate belt.

14. The assembly of claim 13 wherein said inner belt drive rollers is located on opposite sides of the longitudinal centerline of said support surface in adjacent drive units.

15. The assembly of claim 10 wherein said belts define a path of travel in which the item of mail is in contact with pairs of said belts which contact each other over lengths of contact, and there being no roller for any of said belts which is disposed adjacent a roller of its adjacent contacting belt along said lengths of contact.

16. The assembly of claim 15 wherein said assembly is capable of handling items of mail having widths up to the distance between said diverters.

17. The assembly of claim 16 including a light tracking arrangement upstream each set diverters to detect the passage of an item of mail toward its downstream set of diverters.

18. The assembly of claim 17 including an optical reader upstream from said units for reading a portion of the address on each item of mail, and a computer control for controlling the operation of said assembly.

19. The assembly of claim 2 wherein said belts define a path of travel in which the item of mail is in contact with pairs of said belts which contact each other over lengths of contact, and there being no roller for any of said belts which is disposed adjacent a roller of its adjacent contacting belt along said lengths of contact.

20. The assembly of claim 19 wherein said assembly is capable of handling items of mail having widths up to the distance between said diverters.

21. The assembly of claim 1 including an optical reader upstream from said units for reading a portion of the address on each item of mail, and a computer control for controlling the operation of said assembly.

22. The assembly of claim 2 wherein each unit defines a tracking cycle of about 18 inches, and said inner belts contacting each other over a length of about $3\frac{7}{8}$ inches.

* * * * *